US006362706B1

(12) United States Patent
Song et al.

(10) Patent No.: US 6,362,706 B1
(45) Date of Patent: Mar. 26, 2002

(54) CAVITY RESONATOR FOR REDUCING PHASE NOISE OF VOLTAGE CONTROLLED OSCILLATOR

(75) Inventors: Cimoo Song; Chungwoo Kim; Insang Song, all of Yongin; Yongwoo Kwon; Changyul Cheon, both of Seoul, all of (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/542,056

(22) Filed: Mar. 31, 2000

(30) Foreign Application Priority Data

Mar. 31, 1999 (KR) ..... 99-11267

(51) Int. Cl.[7] ..... H01P 7/00
(52) U.S. Cl. ..... 333/219; 333/230; 333/227
(58) Field of Search ..... 333/219, 230, 333/227

(56) References Cited

U.S. PATENT DOCUMENTS

| | | | | |
|---|---|---|---|---|
| 4,211,987 A | | 7/1980 | Pan | |
| 4,890,370 A | * | 1/1990 | Fukuda et al. | 216/2 |
| 5,821,836 A | * | 10/1998 | Katchi et al. | 333/202 |
| 6,130,483 A | * | 10/2000 | Shizuki et al. | 257/778 |
| 6,211,754 B1 | * | 4/2001 | Nishida et al. | 333/219 |

FOREIGN PATENT DOCUMENTS

| | | | | |
|---|---|---|---|---|
| JP | 54-23448 A | * | 2/1979 | H01P/1/20 |
| JP | 63-013401 | | 1/1988 | |
| JP | 4-292003 A | * | 3/1991 | H01P/7/08 |
| JP | 1-98311 A | * | 10/1997 | H03H/3/02 |
| WO | 98/53518 | | 11/1998 | |

OTHER PUBLICATIONS

J. Papapolymerou et al., "A Micromachined High–Q X–Band Resonator", IEEE MicrowaVe and Guided Wave Letters, US, IEEE Inc., New York, vol. 7, No. 6, Jun. 1, 1997, pp. 168–170, XP000690394, ISSN: 1051–8207.

* cited by examiner

*Primary Examiner*—Robert Pascal
*Assistant Examiner*—Dean Takaoka
(74) *Attorney, Agent, or Firm*—Burns, Doane, Swecker & Mathis, L.L.P.

(57) ABSTRACT

There is provided a cavity resonator for reducing the phase noise of electromagnetic waves output from a monolithic microwave integrated circuit (MMIC) voltage controlled oscillator (VCO) by utilizing a semiconductor (e.g., silicon, GaAs or InP) micro machining technique. In the cavity, instead of an existing metal cavity, a cavity, which is obtained by micro machining silicon or a compound semiconductor, is coupled to a microstrip line to allow the cavity resonator to be adopted in a reflection type voltage controlled oscillator. A coupling slot is formed by removing a predetermined size of the part of an upper ground plane film of a cavity facing to the microstrip line. Consequently, the cavity resonator reduces the phase noise of microwaves or millimeter waves which are output from a voltage controlled oscillator.

14 Claims, 6 Drawing Sheets

CAVITY RESONATOR FOR REDUCING PHASE NOISE OF VOLTAGE CONTROLLED OSCILLATOR

Priority is claimed to Korean Application No. 99-11267 filed on Mar. 31, 1999, herein incorporated by reference.

BACKGROUND OF THE INVENTION

1. Field of the Invention

The present invention relates to a cavity resonator for reducing the phase noise of electromagnetic waves output from a monolithic microwave integrated circuit (MMIC) voltage controlled oscillator (VCO) by utilizing a semiconductor (e.g., silicon, GaAs or InP) micro machining technique.

2. Description of the Related Art

Since a microwave/millimeter wave MMIC VCO, which does not use a cavity, outputs electromagnetic waves having large phase noise, the MMIC VCO is not appropriate for use in a radar system using a frequency modulating continuous wave (FMCW). Recently, dielectric disks or transmission lines have been utilized as resonators to reduce phase noise. However, dielectric resonators for millimeter waves are very expensive and are difficult to mass produce because the frequency at which resonance occurs depends on the location of the dielectric resonators and it is difficult to specify the location of the dielectric resonators in an MMIC substrate. Moreover, the Q-factor of transmission line resonators is too small to reduce phase noise.

FIGS. 1A and 1B are a plan view and a sectional view, respectively, of a conventional cavity resonator, and show a structure of an X-band micromachined resonator which is disclosed in IEEE Microwave and Guided Wave Letters, Vol. 7, pp. 168, 1997. The conventional cavity resonator is structured such that two microstrip lines 30 are coupled to a cavity 20 through two slots 10. Such a structure implements a transmission type resonator having an input port and an output port. Since the transmission type resonator has a more complicated feed structure than a reflection type resonator, it is difficult to design the transmission type resonator having a larger Q-factor.

SUMMARY OF THE INVENTION

To solve the above problems, it is an objective of the present invention to provide a cavity resonator for reducing the phase noise of electromagnetic waves output from a monolithic microwave integrated circuit (MMIC) voltage controlled oscillator (VCO) by coupling a silicon micromachined cavity, which has a large Q-factor, to a microstrip line such that the silicon micromachined cavity can be employed in a reflection type VCO.

Accordingly, to achieve the above objective, there is provided a cavity resonator for reducing the phase noise of a voltage controlled oscillator. The cavity resonator includes a cavity formed by a lower metal film and an upper ground plane metal film. The lower metal film is formed by etching a semiconductor into a six-sided or rectangular parallelepiped structure and depositing a conductive film on the six-sided or rectangular parallelepiped structure. The upper ground plane metal film is formed to cover the top of the rectangular parallelepiped structure of the lower metal film. A microstrip line of predetermined width is formed to extend from one end of the cavity across to the other end of the cavity to serve as a waveguide. The microstrip line is disposed a uniform predetermined distance from the upper ground plane metal film of the cavity. A slot is formed perpendicular to the microstrip line by removing a part, of predetermine dimension, of the upper ground plane metal film.

Preferably, the lower metal film, the upper ground metal film and the microstrip line are formed of a conductor selected from the group consisting of gold (Au), silver (Ag) and copper (Cu). The predetermined distance between the microstrip line and the upper ground metal film is maintained by interposing a substrate formed of a semiconductor or an insulating material between them.

In another aspect of the present invention, there is provided a cavity resonator for reducing the phase noise of a voltage controlled oscillator. The cavity resonator includes a cavity formed by a lower metal film and an upper ground metal film. The lower metal film is formed by etching a semiconductor into a rectangular parallelepiped structure and depositing a conductive film on the rectangular parallelepiped structure. The upper ground plane metal film is formed to cover the top of the rectangular parallelepiped structure of the lower metal film. A microstrip line of predetermined width is formed to expand across the cavity to serve as a waveguide. The microstrip line is disposed a uniform predetermined distance from the upper ground plane metal film. Two slots are formed parallel to the microstrip line by removing a part, of predetermine dimension, of the upper ground plane metal film. A matching resistor is inserted into the microstrip line at a predetermined location. The resistor is inserted into the microstrip line by removing a part, of predetermined width, of the microstrip line, at a location corresponding to one end of the cavity.

Preferably, the lower metal film, the upper ground metal film and the microstrip line are formed of a conductor selected from the group consisting of gold (Au), silver (Ag) and copper (Cu). The predetermined distance between the microstrip line and the upper ground metal film is maintained by interposing a substrate formed of a semiconductor or an insulating material between them.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

A cavity resonator for reducing the phase noise of a voltage controlled oscillator and a fabrication method therefor according to the present invention, will now be described more fully with reference to the accompanying drawings, in which preferred embodiments of the invention are shown.

Figure 1A:
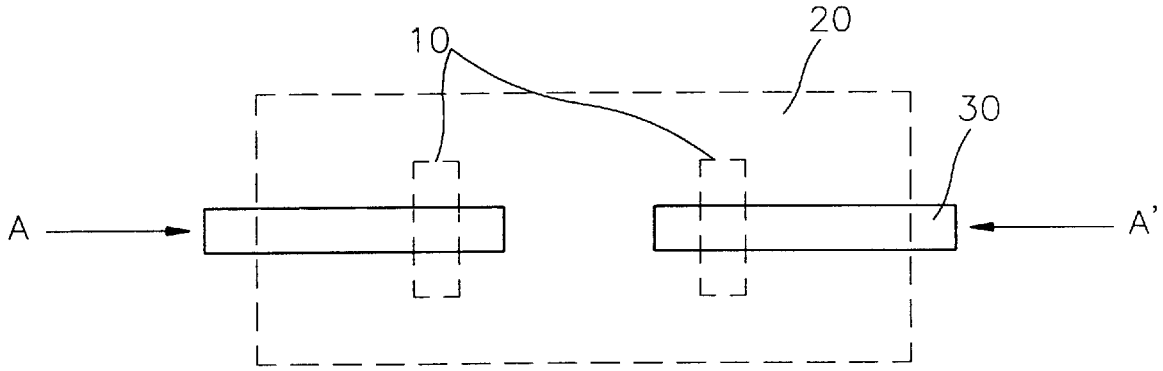
FIG. 1A (PRIOR ART)
FIGS. 1A and 1B are a plan view and a sectional view, respectively, of a conventional cavity resonator.
Figure 1B:
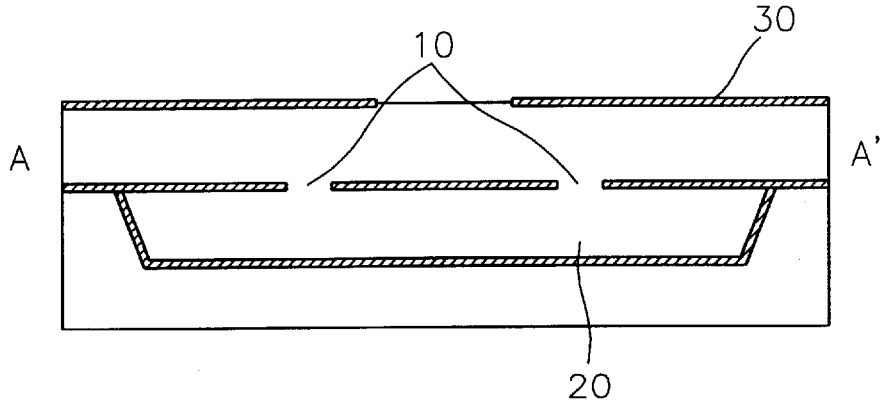
FIG. 1B (PRIOR ART)
Figure 2A:
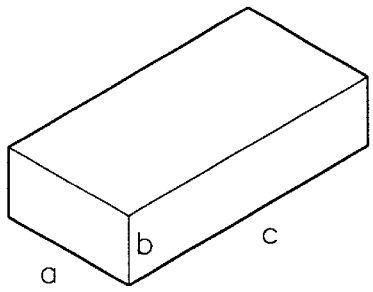
FIG. 2A shows the shape of a cavity which is adopted in a cavity resonator according to the present invention.

The phase noise of oscillators is one of the most important factors influencing the performance of transmitting and receiving systems. The resonance frequency of a rectangular parallelepiped metal cavity, as shown in FIG. 2A, is expressed as the following formula. Reference characters a, b and c indicate the width, depth and length, respectively, of the rectangular parallelepiped metal $$f_{m,l,n} = \frac{v_{ph}}{2}\sqrt{\left(\frac{l}{a}\right)^2 + \left(\frac{m}{b}\right)^2 + \left(\frac{n}{c}\right)^2}$$

Here, $V_{ph}$ is the phase velocity inside the cavity and l, m and n are integers indicating resonance modes. There are three kinds of Q factors used for measuring the performance of a cavity. The three Q factors are defined as follows:

unloaded Q ($Q_U$): $Q_U = f_0/\Delta f = (2\pi f_0)W/P_{loss}$ loaded Q ($Q_L$): unloaded Q considering the input and output load external Q ($Q_E$): $1/Q_E = 1/Q_L - 1/Q_U$.

Figure 2B:
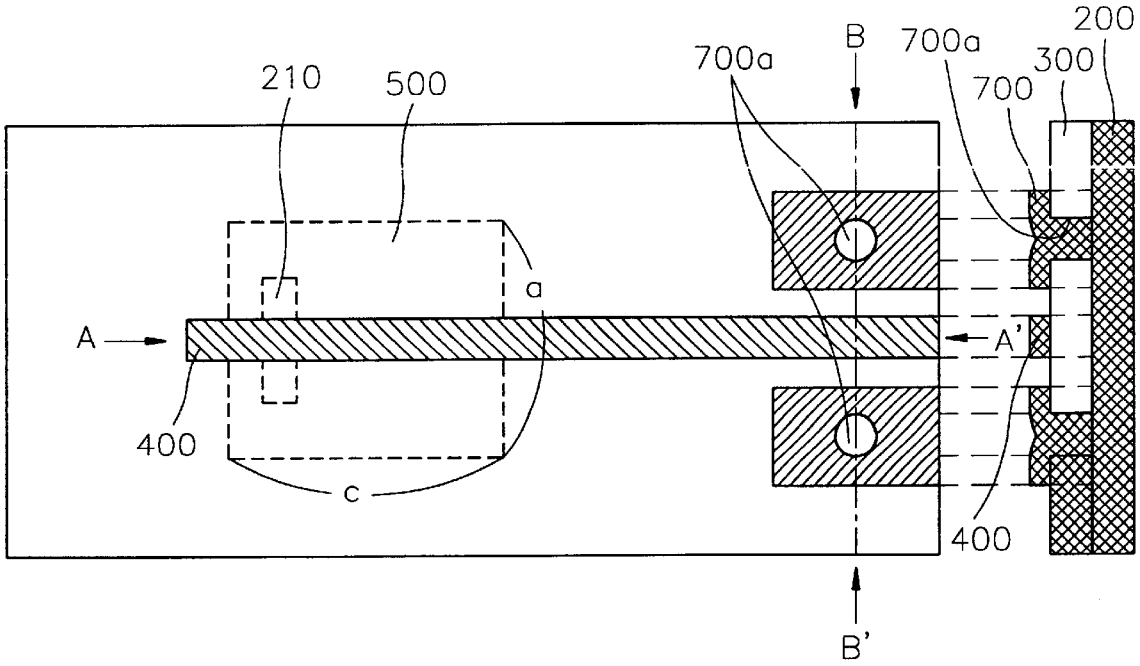
FIG. 2B shows a plan view of a 1-slot reflection type cavity resonator according to the present invention and a sectional view of the 1-slot reflection type cavity resonator taken along the line B—B'.
Figure 2C:
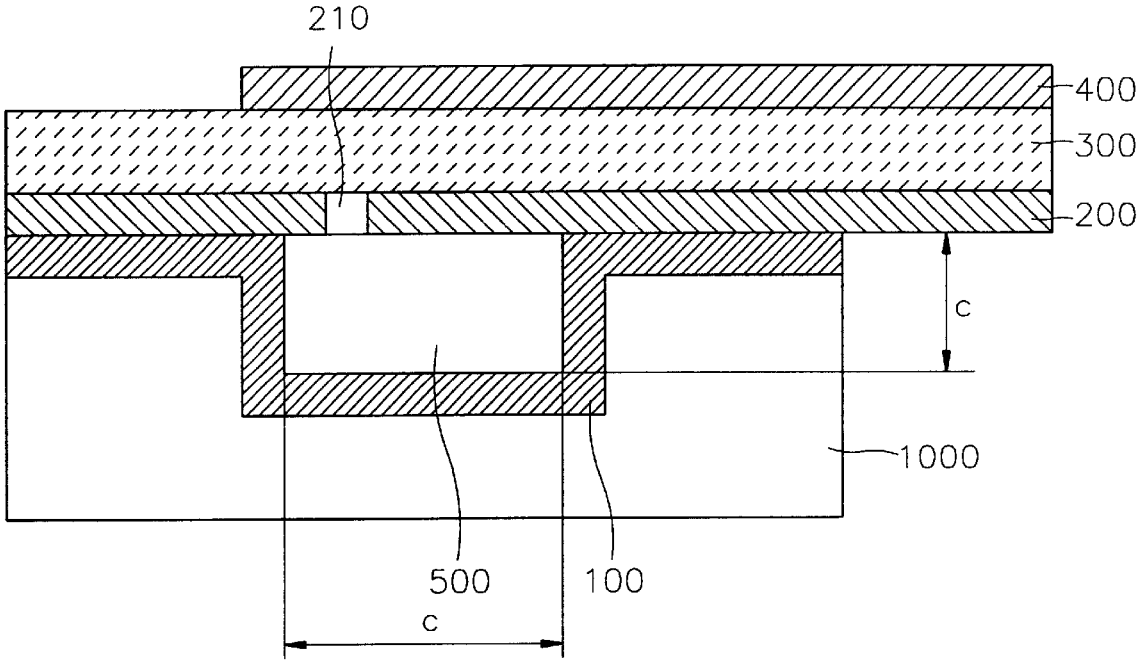
FIG. 2C is a sectional view of the 1-slot reflection type cavity resonator of FIG. 2B taken along the line A—A'.

Here, $f_{m,1,n}$ is a resonance frequency, W is stored energy, and $P_{loss}$ is lost energy. The phase noise is inversely proportional to the square of the Q value of a resonator. Therefore, a resonator having a large Q value is required to reduce phase noise. To excite the resonator, electromagnetic wave energy is coupled to the cavity of the resonator using a coaxial cable, a waveguide (i.e., a microstrip line), or through an aperture. As shown in FIGS. 2B and 2C, a cavity resonator of the present invention has a reflection type structure in which a silicon micromachined cavity having a large Q-factor is coupled to a microstrip line so that the cavity resonator can be utilized in a reflection type voltage controlled oscillator. While a conventional transmission type cavity resonator has input and output ports, a cavity resonator of the present invention is a reflection type cavity resonator having a single port. The reflection type cavity resonator has a simpler feed structure than the transmission type cavity resonator so that it is possible to fabricate a resonator having a larger Q-factor in the present invention. The structure of such cavity resonator according to the present invention, will now be described in detail.

FIGS. 2B and 2C are a plan view and a sectional view, respectively, for showing the schematic structure of a 1-slot reflection type cavity resonator. As shown in FIGS. 2B and 2C, the cavity resonator of the present invention basically has a structure in which, instead of a metal cavity, a cavity 500, which is formed of a silicon or compound semiconductor substrate 1000 using a micro machining technology, is coupled to a micro strip line 400. The cavity 500 is formed by a lower cavity film 100, which is a rectangular parallelepiped structure defined by a metal film such as a gold (Au) film and an upper ground plane film 200, which covers the top of the lower cavity film 100. The microstrip line 400 is formed of a conductive film having an excellent conductivity such as a gold (Au) film, a silver (Ag) film or a copper (Cu) film. The microstrip line, which serves as a waveguide, is positioned at a predetermined distance from the upper ground plane film 200 of the cavity 500. A substrate 300 of Si, glass or a compound semiconductor is interposed between the microstrip line 400 and the upper ground plane film 200 of the cavity 500 to maintain the predetermined distance between the waveguide of the microstrip line 400 and the upper ground plane film 200. This predetermined distance is preferably 100 to 1000 micrometers because the width of the microstrip line 400 is dependent on the thickness and dielectric constant of substrate 300. Through holes 700*a* are formed on the substrate 300 on both sides of the microstrip line 400. Grounding pads 700 are formed over the through holes 700*a* and connected to the upper ground plane film 200. The microstrip line 400 stops near one end of the cavity 500. A single rectangular slot 210, perpendicular to the microstrip line 400, is formed on the upper ground film 200 near the one end, thereby guiding electromagnetic waves, which have been guided along the waveguide including the upper ground plane film 200 and the microstrip line 400, to the cavity 500 and thus generating resonance.

A 1-slot reflection type cavity resonator having such structure draws a signal output from a VCO to a microstrip line 400 and generates an electromagnetic wave mode in the cavity 500 using the electromagnetic wave coupling between the microstrip line 400 and the cavity 500. The electromagnetic wave coupling between the microstrip line 400 and the cavity 500 is established using the slot 210 which is appropriately formed. The electromagnetic waves at a stable mode in the cavity 500 are transferred to the microstrip line 400 through the slot 210 and output to an antenna. In other words, in a 1-slot cavity resonator as shown in FIGS. 2B and 2C, electromagnetic waves output from a VCO progress toward a slot along a microstrip line and are coupled to a cavity near the slot. Then, the electromagnetic waves excite a dominant cavity mode, $TE_{110}$, in the cavity so that electromagnetic waves having stabilized resonance frequency are output through the microstrip line.

Figure 3:
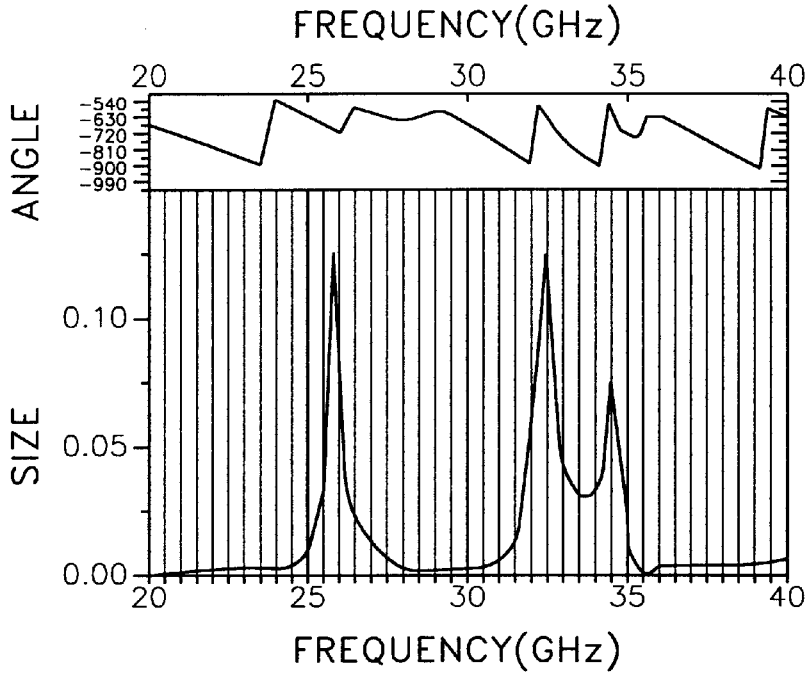
FIG. 3 is a graph for showing the frequency characteristic in the 1-slot reflection type cavity resonator depicted in FIGS. 2B and 2C.
Figure 4:
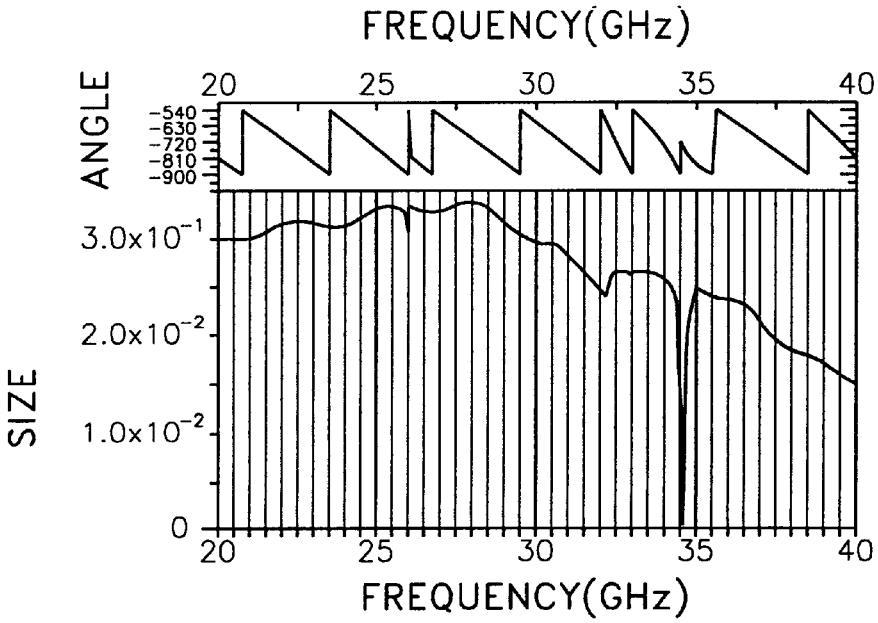
FIG. 4 is an S11 parameter of electromagnetic waves output from the 1-slot reflection type cavity resonator depicted in FIGS. 2B and 2C.

FIG. 3 shows a frequency characteristic curve illustrating a frequency characteristic in the 1-slot reflection type cavity resonator described above. FIG. 4 shows an S11 parameter of the output electromagnetic waves of the 1-slot reflection type cavity resonator. Generally, a monolithic microwave integrated circuit (MMIC) voltage controlled oscillator (VCO) outputs electromagnetic waves having large phase noise so that the MMIC VCO is difficult to apply to a radar system using FMCW, but the 1-slot reflection type cavity resonator according to the present invention can greatly reduce the phase noise of the VCO.

Figure 5A:
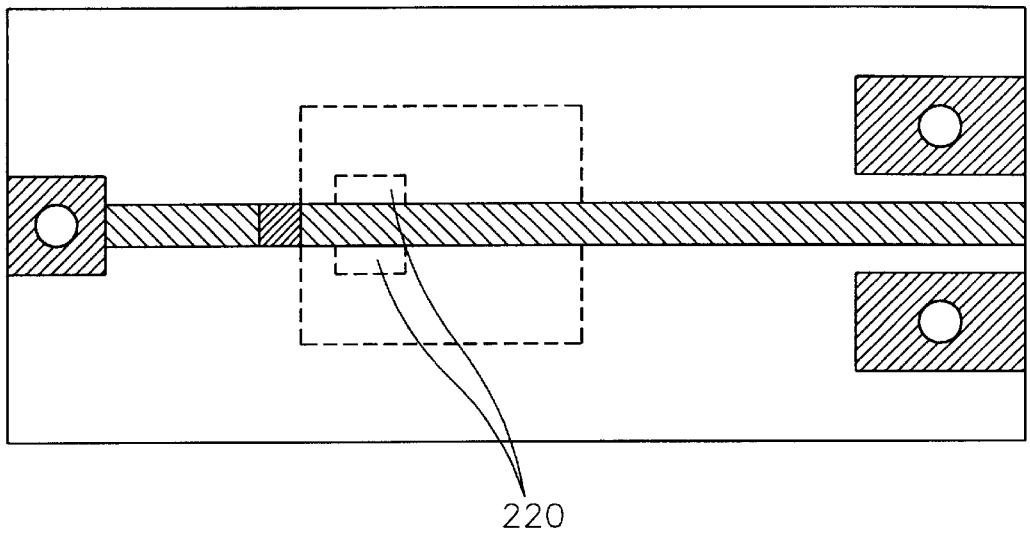
FIGS. 5A and 5B are a plane view and a sectional view, respectively, of a 2-slot cavity resonator according to the present invention.
Figure 5B:
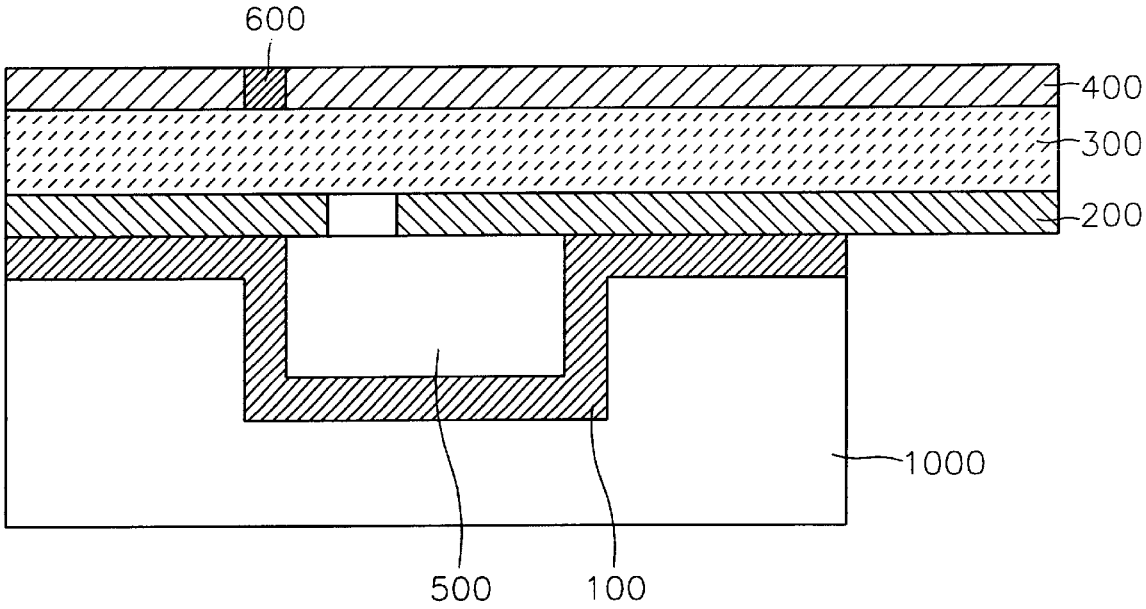
Figure 6:
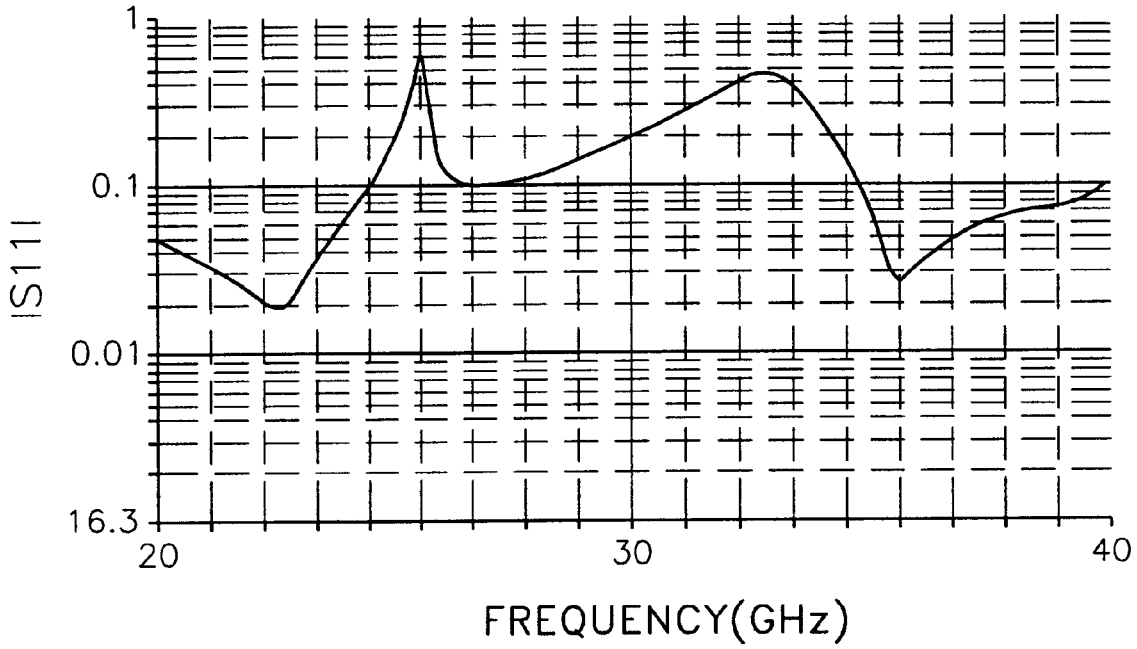
FIG. 6 shows an S11 parameter of electromagnetic waves output from the 2-slot cavity resonator depicted in FIGS. 5A and 5B.

FIGS. 5A and 5B are a plan view and a sectional view, respectively, of a 2-slot cavity resonator. The 2-slot cavity resonator is obtained by making the above embodiment of a 1-slot reflection type cavity resonator into a transmission type. The operational principle of the 2-slot cavity resonator is the same as that of the embodiment shown in FIGS. 2B and 2C. The 2-slot cavity resonator has a 50 Ω matching resistor 600, in the microstrip located at a position corresponding to the one end of the cavity 500. The resistor attenuates electromagnetic waves having frequencies other than the resonance frequency. The 2-slot cavity resonator also has two slots 220 in the upper ground plane film 200, parallel to each other located on both sides of the microstrip line 400. Those members which are designated by the same reference numerals as those of FIGS. 2B and 2C are formed of the same materials as in the 1-slot reflection type cavity resonator in FIGS. 2B and 2C. FIG. 6 shows an S11 parameter characteristic of electromagnetic waves output from the 2-slot cavity resonator which is a second embodiment of the present invention. It can be seen from the result that the 2-slot cavity resonator is not as good as the 1-slot reflection type cavity resonator.

As described above, in a cavity resonator for reducing the phase noise of a voltage controlled oscillator according to the present invention, includes a cavity, obtained by micro machining silicon or a compound semiconductor instead of an existing metal cavity, which is coupled to a microstrip line to allow the cavity resonator to be adopted in a reflection type voltage controlled oscillator. A coupling slot is formed by removing a predetermined size of the part of an upper ground plane film of a cavity facing to the microstrip line. Consequently, the cavity resonator of the present invention reduces the phase noise of microwaves or millimeter waves which are output from a voltage controlled oscillator.

What is claimed is:

1. A cavity resonator comprising:

a semiconductor having a cavity which is defined by four sides, an upper surface and a lower surface;

a lower metal film located on said four sides and on said lower surface of said cavity in said semiconductor;

an upper ground plane metal film which covers said upper surface of said cavity in said semiconductor;

a microstrip line, of predetermined width, which extends from one end of the cavity across to the other end of the cavity to serve as a waveguide, wherein the microstrip line is disposed a uniform predetermined distance from the upper ground plane metal film of the cavity opposite to said lower surface of said cavity; and a slot in said upper ground plane metal film, wherein the slot is positioned perpendicular to the microstrip line.

2. The cavity resonator of claim 1, wherein the lower metal film and the upper ground metal film are formed of a conductor selected from the group consisting of gold (Au), silver (Ag) and copper (Cu).

3. The cavity resonator of claim 1, wherein the microstrip line consists of at least one a conductor selected from the group consisting of gold (Au), silver (Ag) and copper (Cu).

4. The cavity resonator of claim 1, further comprising a substrate of a semiconductor or insulating material interposed between said microstrip line and said upper ground metal film wherein the predetermined distance between the microstrip line and the upper ground metal film is maintained by said substrate.

5. The cavity resonator of claim 4, further comprising:

through holes which are formed in said substrate for maintaining the distance between the microstrip line and the upper ground metal film, wherein the through holes are positioned on both sides of the microstrip line; and grounding metal pads which are formed to be connected to the upper ground plane metal film through the through holes.

6. The cavity resonator of claim 4, wherein the semiconductor is silicon (Si) or a compound semiconductor.

7. The cavity resonator of claim 4, wherein the insulating material is glass.

8. A cavity resonator comprising:

a semiconductor having a cavity which is defined by four sides, an upper surface and a lower surface;

a lower metal film located on said four sides and on said lower surface of said cavity in said semiconductor;

an upper ground plane metal film which covers said upper surface of said cavity in said semiconductor;

a microstrip line, of predetermined width, which extends from one end of the cavity across to the other end of the cavity to serve as a waveguide, wherein the microstrip line is disposed a uniform predetermined distance from the upper ground plane metal film of the cavity opposite to said lower surface of said cavity; and two slots, of predetermined dimension, in said upper ground plane metal film, wherein the two slots are parallel to each other and positioned on each side of the microstrip line; and a matching resistor which is positioned within a gap, of predetermined width, of the microstrip line, wherein the resistor is positioned at the location corresponding to one end of the cavity.

9. The cavity resonator of claim 8, wherein the lower metal film and the upper ground metal film are formed of a conductor selected from the group consisting of gold (Au), silver (Ag) and copper (Cu).

10. The cavity resonator of claim 8, wherein the microstrip line consists of at least one a conductor selected from the group consisting of gold (Au), silver (Ag) and copper (Cu).

11. The cavity resonator of claim 8, further comprising a substrate of a semiconductor or insulating material interposed between said microstrip line and said upper ground metal film wherein the predetermined distance between the microstrip line and the upper ground metal film is maintained by said substrate.

12. The cavity resonator of claim 11, further comprising:

through holes which are formed in said substrate for maintaining the distance between the microstrip line and the upper ground metal film, wherein the through holes are positioned on both sides of the microstrip line; and grounding metal pads which are formed to be connected to the upper ground plane metal film through the through holes.

13. The cavity resonator of claim 11, wherein the semiconductor is silicon (Si) or a compound semiconductor.

14. The cavity resonator of claim 11, wherein the insulating material is glass.

* * * * *